US005487406A

United States Patent [19]

Jirasek

[11] Patent Number: 5,487,406

[45] Date of Patent: Jan. 30, 1996

[54] DRAIN CONTROL VALVE AND MANIFOLD SYSTEM

[76] Inventor: James D. Jirasek, 109 S. 31st St., Temple, Tex. 76504

[21] Appl. No.: 315,510

[22] Filed: Sep. 30, 1994

[51] Int. Cl.[6] ..... F16K 15/14; F16K 37/00; D06F 39/08

[52] U.S. Cl. ..... 137/519; 137/517; 137/217; 137/557; 137/847; 68/208; 239/289

[58] Field of Search ..... 137/496, 217, 137/517, 519, 557, 843, 847; 68/208; 239/289

[56] References Cited

U.S. PATENT DOCUMENTS

| | | | |
|---|---|---|---|
| 1,281,974 | 10/1918 | Kaeding | 137/847 X |
| 2,662,724 | 12/1953 | Krauagna | 137/847 |
| 2,764,183 | 9/1956 | Gollehon | 137/517 X |
| 2,781,061 | 2/1957 | Frey | 137/517 X |
| 3,060,882 | 10/1962 | Peters et al. | 137/846 X |
| 3,167,089 | 1/1965 | Gordon | 137/517 |
| 3,324,877 | 6/1967 | Bochan | 137/846 X |
| 3,417,775 | 12/1968 | Smith | 137/218 |
| 3,586,040 | 6/1971 | Urback | 137/517 |
| 3,895,646 | 7/1975 | Howat | 137/517 X |
| 4,069,837 | 1/1978 | Jirasek | 68/208 X |
| 4,938,259 | 7/1990 | Schmidt | 137/517 X |
| 5,099,874 | 3/1992 | Della Cave | 137/357 |
| 5,117,660 | 6/1992 | Downs et al. | 68/208 |

FOREIGN PATENT DOCUMENTS

| | | | |
|---|---|---|---|
| 1237678 | 6/1971 | United Kingdom | 137/517 |

*Primary Examiner*—John Rivell
*Attorney, Agent, or Firm*—Stephen R. Greiner

[57] ABSTRACT

A valve for permitting fluid flow in a first desired direction and preventing fluid flow in a reverse direction. The valve includes a valve body having a rigid wall defining inlet and outlet openings at opposite ends thereof and a main flow passageway between the inlet and outlet openings. Secured to the rigid wall, so as to receive fluid entering the passageway through the inlet opening, is a tubular valve member of elastomeric material having upstream and downstream ends in fluid communication with one another. The tubular valve member is normally open to fluid flow but is yieldingly collapsible in response to downstream pressure increases to prevent fluid from passing therethrough. A ring is secured about the tubular valve member and is dimensioned to prevent the passage of the downstream end through the inlet opening in the event of a downstream pressure increase. The drain control valve may be employed in conjunction with a novel manifold for irrigation purposes.

20 Claims, 4 Drawing Sheets

DRAIN CONTROL VALVE AND MANIFOLD SYSTEM

FIELD OF THE INVENTION

The present invention relates generally to fluid handling apparatus and, in particular, to such apparatus permitting fluid movement through a passageway in one direction and having means for preventing the back-flow of fluid therethrough.

BACKGROUND OF THE INVENTION

In this century, machines have come to be widely used for washing articles of clothing. These machines typically run through an automatic sequence of washing, rinsing, and spin-drying steps alternatingly receiving and discharging water with each step. The discharged "grey" water, including contaminating detergents and suspended particulate matter, is most often conveyed through the drainage system of a building structure into a public sewer line for ultimate disposal. In some instances, however, blockages in such drainage systems have lead to large volumes of grey water being discharged onto the floor of a building structure and causing considerable damage thereto.

In my prior patent, U.S. Pat. No. 4,069,837, issued Jan. 24, 1978, a device for detecting a blockage in a drainage system and preventing a damaging overflow condition by disabling a washing machine was disclosed. In order to function as intended, the device illustrated in my patent required a readily-achieved, fluid-tight seal with the stand-pipe or inlet to the drainage system of a building structure. While my original device was fully effective in accomplishing its principal intended purpose, i.e., preventing unintended spillage, the pressurized back-flow of fluid through the stand-pipe or drainage system inlet was found not to be substantially deterred from reentering a washing machine after its initial discharge.

In highrise apartments and washaterias, where multiple clothes washing machines discharge grey water into a common drainage system, the potential for fluid back-flow is especially acute. As a single washing machine is discharging its liquid contents under pressure, a downstream blockage can lead to the undesired entry of the just pumped grey water into several other machines and contamination of the contents thereof.

SUMMARY OF THE INVENTION

In view of the problems associated with the prior devices for detecting a blockage in a drainage system and preventing a damaging overflow condition by disabling a washing machine, a novel valve has been developed for permitting fluid movement through its main flow passageway in one direction and having means for preventing the back-flow of fluid therethrough. The novel valve includes a rigid body having a tubular valve member of flexible, elastomeric material secured thereto. The tubular valve member has upstream and downstream ends in fluid communication with one another and is normally open for fluid flow therebetween. In response to downstream pressure increases, however, the tubular valve member is yieldingly collapsible so as to prevent fluid from passing therethrough. A ring, dimensioned to prevent the passage of said downstream end through the inlet opening of the rigid valve body in the event of a downstream pressure increase, is secured about said tubular valve member.

Such a valve construction is a significant improvement over prior check valves incorporating an elastomeric element in that no rigid element projecting into, or across, the fluid flow stream is required for the support thereof. Thus, frictional resistance to fluid flow, formerly caused by screens or props of various configurations, is eliminated. Furthermore, when the instant valve is used to control the flow of a liquid which contains suspended impurities such as lint or hair, there will be absolutely no tendency for such filamentary matter to build up within the valve as often happens when a projection into the flow stream is provided.

In order to optimally utilize the waste or "grey" water discharged from clothes washing machine, a novel manifold is proposed for use with a valve of the type hereinabove described. The manifold includes a connection to a municipal, potable water source for flushing such after use. Of course, the need for preventing the back-flow of contaminated liquids into a supply of potable water has long been recognized. For public health reasons, local plumbing codes often include provisions mandating the use of certain apparatus for preventing the suction of contaminants into potable water conduits in the event of a system failure. In this regard, the manifold is provided with a tubular valve member of flexible, elastomeric material which is yieldingly collapsible and adapted to prevent fluid from passing into the municipal water source in the event of a back pressure condition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
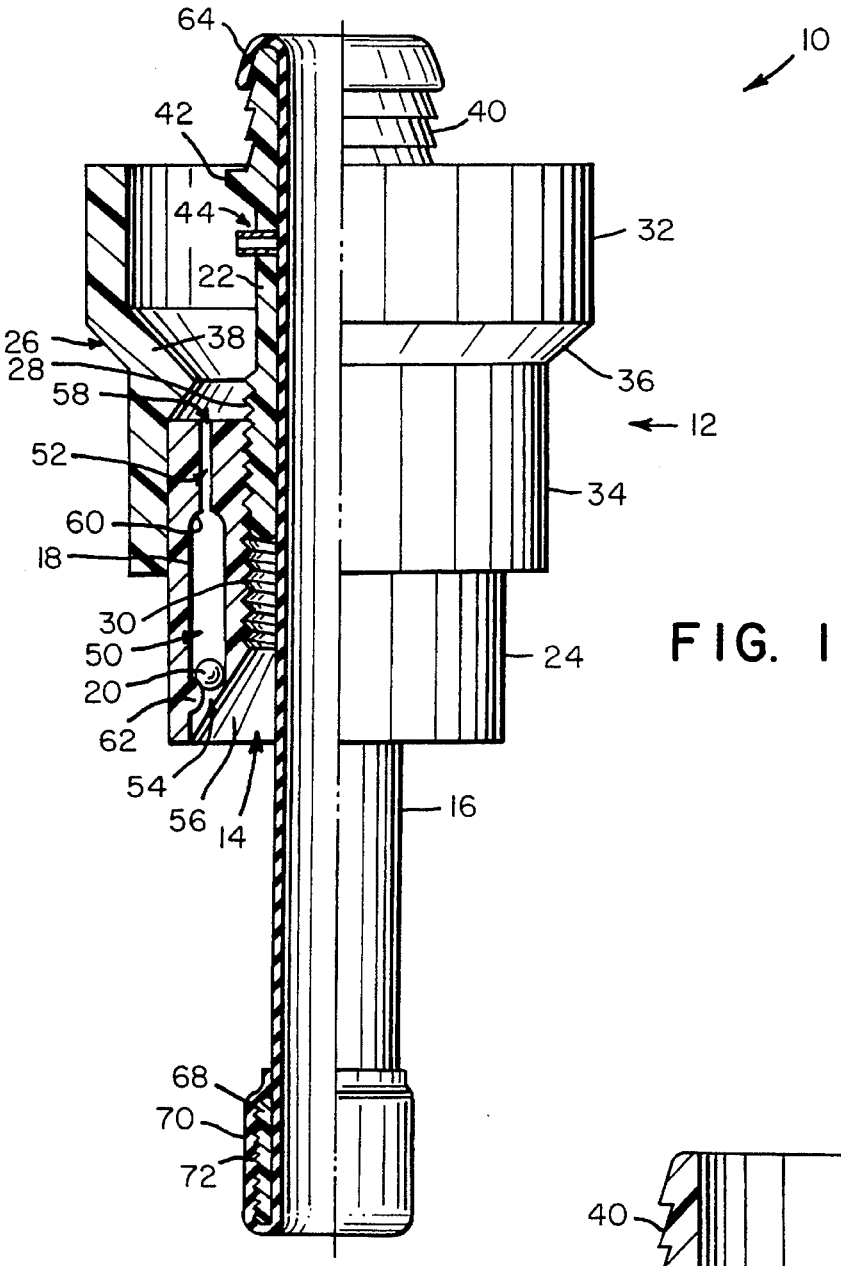
FIG. 1 is a side elevational view, partially in cross section, illustrating a drain control valve in accordance with the present invention.

Referring now to FIG. 1 of the drawings, there is shown a drain control valve 10 in accordance with the present invention. Broadly, the drain control valve 10 includes a body 12 having a central, axially-extending passageway 14 for the main flow of fluid through the body 12. Disposed within the passageway 14 is an elastomeric valve member 16 adapted for preventing the back-flow of fluids through the passageway 14. A secondary passageway or aperture 18, in the valve body 12, having a ball valve element 20 disposed therein interconnects the passageway 14 with the atmosphere and acts as an anti-siphon feature. Thus, it is to be understood that the drain control valve 10 checks the unintended flow of fluid through the passageway in both directions.

The preferred valve body 12 is of three-part construction and comprises: inlet member 22, outlet member 24, and cup member 26. As may be seen, the inlet member 22 is a hollow tube having, at its lower end, threads 28 about the exterior thereof. Likewise, the outlet member 24 is a hollow tube, albeit with a larger relative diameter than that of the inlet member 22, having threads 30 about its interior which are adapted for fluid-tight engagement with threads 28. When threadably engaged, the tubular inlet and outlet members 22 and 24 define the passageway 14 which is the principal fluid conveyance channel through the drain control valve 10. Secured about the periphery of the inlet and outlet members 22 and 24 is the cup member 26. The cup member 26 includes an upper cylindrical portion 32 and a lower cylindrical portion 34, of relatively smaller diameter, joined together by an integral, conical intermediate portion 36. The lower cylindrical portion 34 of the cup member 26 is placed in fluid-tight engagement with the outlet member 24 by sliding the close-fitting outlet member into the lower cylindrical portion thereby snugly contacting the exterior surface of the outlet member with the interior surface of the lower cylindrical portion. An inwardly directed flange 38, provided in the cup member 26 at the junction between the conical intermediate portion 36 and lower cylindrical portion 34, supplies a stop to the continued axial movement of the outlet member 24 into the lower cylindrical portion when such are being engaged.

The inlet member 22 includes a plurality of laterally-spaced, peripheral ridges 40 at its upper end provided principally for gripping a resilient drain hose so as to connect the valve 10 to a fluid source such as a clothes washing machine for use. A peripheral flange 42 is disposed adjacent the lowermost one of the ridges 40 and extends outwardly beyond such so as to provide a stop capable of exactly positioning the drain hose upon the inlet member 22.

Figure 2:
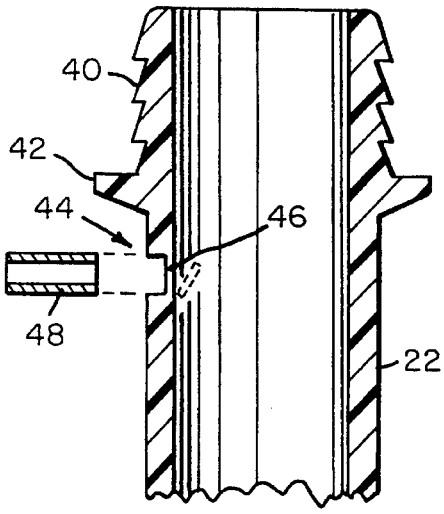
FIG. 2 is a cross-sectional view of a portion of the drain control valve showing the installation of the cylindrical tap therein.

Positioned between the peripheral flange 42 and the threads 28 is a bore 44 which traverses a side wall of the inlet member 22, intersecting the passageway 14 and providing fluid communication therebetween. With reference to FIG. 2, however, it may be seen that the bore 44 is initially fully obstructed by an integrally formed knock-out plug 46. The bore 44, then, is first opened by the application of an external force to the plug 46 sufficient to detach the plug 46 from the inlet member 22 and discharge the plug 46 from the bore 44. After removal of the plug 46, a tubular tap 48 is secured within bore 44 so that the external end portion of the tap 48 is in fluid communication with the passageway 14.

An aperture 18, positioned within a side wall of the outlet member 24, interconnects the passageway 14 with the atmosphere. The aperture 18 is provided with a lower section 50 and an upper section 52, in fluid communication therewith, having a relatively smaller diameter. As shown, the aperture 18 is positioned substantially parallel to the passageway 14, and has a single entrance at each of its opposed ends. A lower entrance 54, in an upwardly sloping and conically-shaped wall 56 extending from the threads 30 to the bottom of the outlet member 24, provides direct access to the lower section 50. An upper entrance 58, on the other hand, in the top of the outlet member 24, provides direct access to the upper section 52.

A longitudinally-movable ball valve element 20, having a diameter somewhat greater than that provided to the upper section 52, is positioned within the lower section 50. In applications where the valve 10 is utilized in controlling the flow of liquids, the ball valve element 20 is preferably formed of a material having a density somewhat less than that of a liquid so that such may float thereon. (When water is the liquid being controlled, neoprene has been found to be a suitable material for forming element 20.) Thus, a valve seat 60 is formed at the junction of the lower and upper sections 50 and 52. An integral projection 62 partially traverses the lower entrance 54 to maintain ball valve element 20 within the lower section 50. Thus, the movement of the ball valve element 20 within the lower section 50 is limited by the projection 62 when the aperture 18 is open for fluid flow and by the valve seat 60 when the aperture 18 is in a closed position due to pressure build-up within the passageway 14.

With continuing reference to FIG. 1, it may be seen that portions of the cup member 26 project upwardly from the outlet member 24 to a predetermined height above the outlet member and that the upper entrance 58 is at an elevation lower than that of the top of the cup member 26. Thus, small amounts of liquid which inadvertently leak past the valve seat 60 under conditions of excessive fluid pressure in the passageway 14 will be collected within the open space formed within the cup member 26 and will not spill onto a floor or other surface. When the conditions of excessive pressure within the passageway 14 are relieved, the collected liquid will drain under the force of gravity through the aperture 18 and into the passageway 14 for ultimate disposal.

Fixed substantially within the passageway 14 of the valve body 12 is an elastomeric valve member 16. The elastomeric valve member may be formed of any suitable elastomeric material such as natural or synthetic rubber or any appropriate type of plastic. In this regard, ethylene-propylene terpolymer, more commonly known as EPT rubber, may be advantageous. EPT rubber has the desirable characteristics of being resistant to degradation by: ozone, hot water, detergent and bleach. Further, EPT rubber is resistant to compression set and retains its flexibility after long periods of exposure to either high or low temperatures. EPT rubber thus imparts several ideal qualities to the elastomeric valve member 16 which, in one of its foreseeable uses involving clothes washing machines, would be exposed to hot and cold detergent solutions while being under varying degrees of physical deformation.

The elastomeric valve member 16 is molded or otherwise manufactured to have a tubular form of substantially constant diameter and wall thickness throughout its length. Preferably, the outer diameter of the elastomeric valve member 16 is not larger than the inner diameter of the inlet member 22 so that the collapse of the elastomeric valve member, under conditions of back-pressure in the passageway 14, will not be encumbered. As illustrated, the upper end of the elastomeric valve member 16 is fixed to the upper end of the inlet member 22 by having a portion thereof turned back as indicated at 64 over the upper end of the inlet member 22 so that such turned back portion will engage at least one of the plurality of peripheral ridges 40. Thus, when a drain hose 66 is fitted onto the upper end of the inlet member 22, as is shown in FIG. 3, the inner wall of the drain hose 66 will press against the turned back portion 64 of the elastomeric valve member 16 and compress it into at least one of the peripheral ridges 40 thereby forming a water-tight seal between the upper end of the elastomeric valve member 16 and the valve body 12.

A ring 68 is secured to the lower, free end of the elastomeric valve member 16 for keeping the free end of the elastomeric valve member open and retaining the elastomeric valve member in slight tension. As may seen in FIG. 1, the ring 68 is secured in place by turning back a portion of the elastomeric valve member 16, as indicated at 70, over the ring 68 so that such turned back portion 70 will engage the peripheral surface of the ring 68 and completely isolate such from potential contact with fluids passing through the drain control valve 10. As shown, the ring 68 comprises a pipe nipple, formed from a corrosion-resistant material such as brass, having threads 72 about its external periphery which assist in retaining the turned back portion 70 in position. As an alternative to the threads 72, ribs or serrations may be applied to the peripheral surface of the ring. Preferably, the ring 68 has an outer diameter greater than that of the inner diameter of the inlet member 22 so as to prevent the complete passage of the ring 68 and elastomeric valve member 16 through the passageway 14 under extreme back-pressure conditions. Further, the preferred ring 68 has an inner diameter sufficient to receive the elastomeric valve member 16 without substantially restricting the cross-sectional area available for fluid flow through the elastomeric valve member.

The mass of the ring 68 may be varied at installation in response to differences in the thickness and composition of the material comprising the elastomeric valve member 16. Generally, however, a mass which is too great would stretch the elastomeric valve member 16, creating considerable stress in the material throughout the stretched area, so that the elastomeric valve member would strongly resist being collapsed or closed by fluid in a back-pressure condition. On the other hand, insufficient mass may undesirably permit portions of the elastomeric valve member 16 to be expelled from the top of the inlet member 22 of the valve body 12 in a back-pressure condition. Thus, in determining an appropriate mass for the ring 68, the physical characteristics of the elastomeric valve member 16 as well as the intended environment of use must be taken into account.

Figure 3:
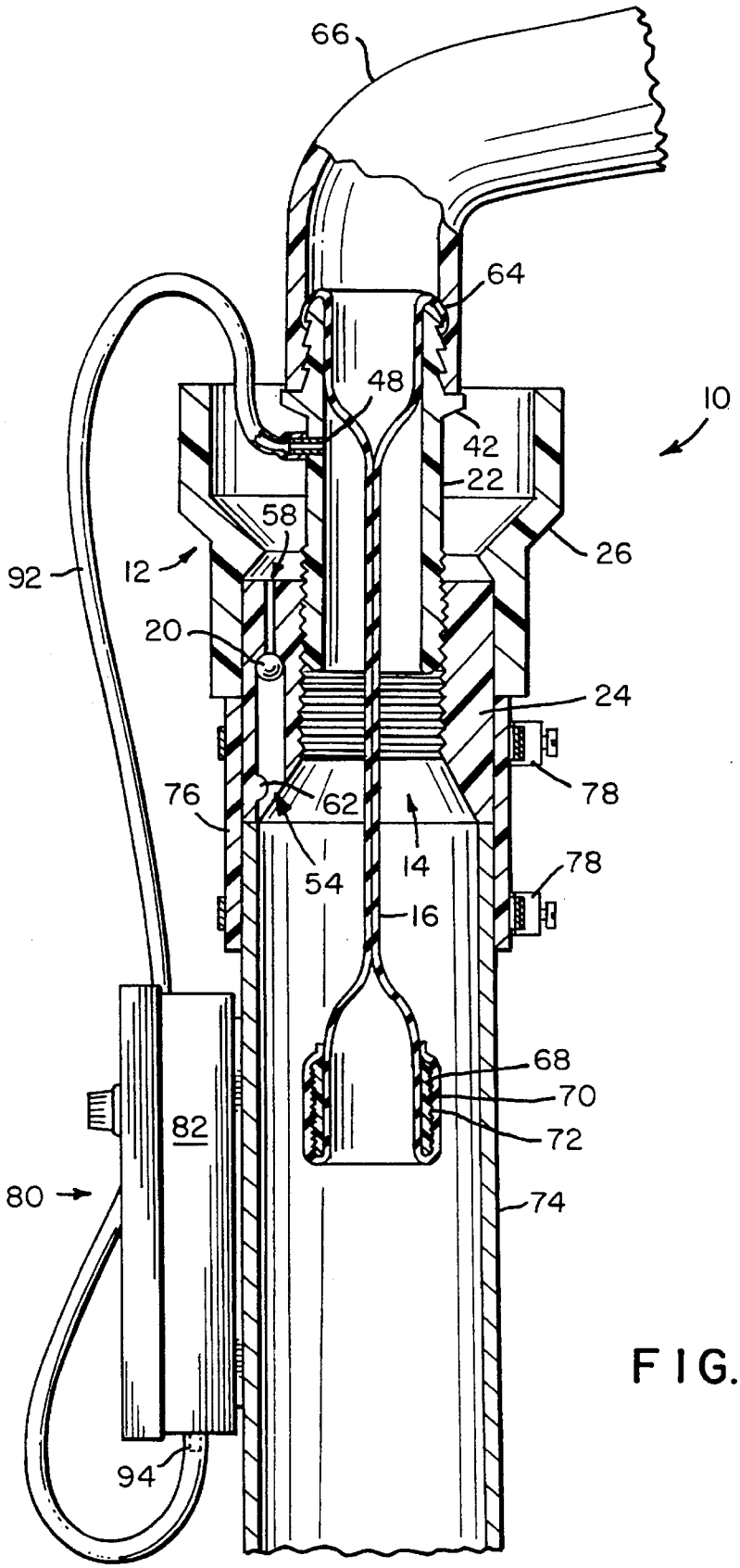
FIG. 3 is a cross-sectional view of the drain control valve of FIG. 1 installed upon the stand-pipe of a fluid drainage system and employed in combination with a pressure sensing alarm unit, the elastomeric tubular body being collapsed to prevent the back-flow of fluid through the valve.
Figure 4:
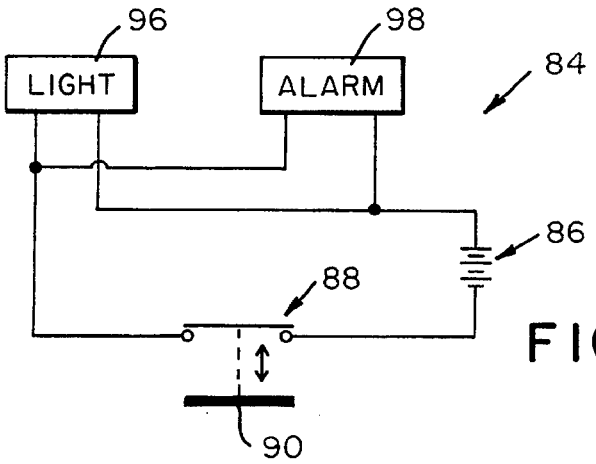
FIG. 4 is an electric circuit diagram of a pressure sensing alarm unit for use with the drain control valve of the present invention.

Referring now to FIGS. 3 and 4, the installation of the drain control valve 10 upon a stand-pipe 74 of a fluid drainage system is illustrated. As may be seen, a rubber sleeve 76 is fitted about both the stand-pipe 74 and the outlet member 24. Secured about the sleeve 76, proximate each of its ends, are a pair of hose clamps 78 of well known construction for providing a fluid-tight seal between the drain control valve 10 and the stand-pipe 74. The upper end of the inlet member 22 is connected, in a fluid-tight relationship, with the drain hose 66 so that liquid can be passed through the drain hose 66, elastomeric valve member 16, and stand-pipe 74 into the usual drainage system (not shown) of an associated building structure.

The drain control valve 10 is operatively connected to a pressure sensitive control unit 80. The pressure sensitive control unit 80 can be any apparatus which is known in the art, such as that disclosed in U.S. Pat. Nos. 3,091,111 and 3,133,917 hereby incorporated by reference for all purposes. Preferably, however, the control unit 80 is provided with a housing 82 and an electrical control circuit 84 positioned within the housing. The pressure sensitive control unit 80 may be provided with an internal source of electrical current such as a 9-volt battery 86. Alternatively, electrical current may be supplied to the control circuit 84 of the control unit 80 via a well-known 110-volt transformer and power cord arrangement (not shown).

Pressure sensitive control unit 80 includes a pressure responsive electric switch 88 having a diaphragm 90 which may be slightly deformed to actuate the switch 88 in response to changes in fluid pressure within the drain control valve 10. Fluid pressure changes may be transmitted to the diaphragm 90 through any suitable means including a conduit 92 having its opposed ends in fluid communication with both the tubular tap 48 and an inlet tube 94 mounted on the housing 82 which, itself, is in fluid communication with the diaphragm 90. When fluid pressure within the inlet tube 94 exceeds a predetermined level, the pair of normally open electrical contacts comprising the switch 88 are placed into electrical contact with one another. Electric alarm units, such as a light 96 and a buzzer 98 may be connected in series with the switch 88 so that upon fluid pressure exceeding a predetermined limit a visual or audible alarm is activated by the closing of the contacts to alert a user of the event.

If a blockage in the drainage system induces a back-flow situation in stand pipe 74, the valve 10 will function to prevent the back flow of contaminated fluids from the outlet member 24 toward the inlet member 22 thereof. Where there tends to be a backward flow, that is, from bottom to top as viewed in FIG. 3, the pressure on the outside of the elastomeric valve member 16 tends to collapse the tubular wall thereof and snugly press its opposite sides together along a substantially planar surface thereby closing the member 16 to fluid flow. Simultaneously, the back-flow of fluid into the aperture 18 presses the ball valve element 20 into the valve seat 60 thereby sealing the aperture 18. If the back-flow condition creates a significant rise in pressure in the conduit 92, the pressure sensitive control unit 80 may sound an alarm. This is, in essence, the condition shown in FIG. 3.

When, however, there is pressure upstream of the valve 10, that is, there is to be flow through the valve from top to bottom, the upstream pressure causes the elastomeric valve member 16 to return to an open condition as shown in FIG. 1. It is to be noted that the elastomeric valve member 16, when open, provides a substantially straight passage to the flow of fluid therethrough without friction-inducing impedances caused by projections into the fluid flow path. In addition to the open elastomeric valve member 16, however, open aperture 18 maintains atmospheric pressure within the passageway 14 and stand pipe 74 when substantial pressure is not present in same so as to prevent a suction from being created across the valve 10. Thus, the aperture 18, prevents the siphoning of fluid through the drain control valve 10.

Although the valve 10 may be mounted in essentially any orientation, a vertical position is preferred. A vertical position permits the elastomeric valve member 20 to be suspended in the center of the passageway 14 without, otherwise, partially collapsing under the influence of gravity and increasing drag forces associated with fluid flow through the valve.

Although operation of the drain valve of the instant invention was described with reference to the embodiment of FIGS. 1–3, it is to be understood that the embodiment of FIG. 5, described fully hereinbelow, functions in essentially the same manner in preventing the back-flow of fluid therethrough.

Figure 5:
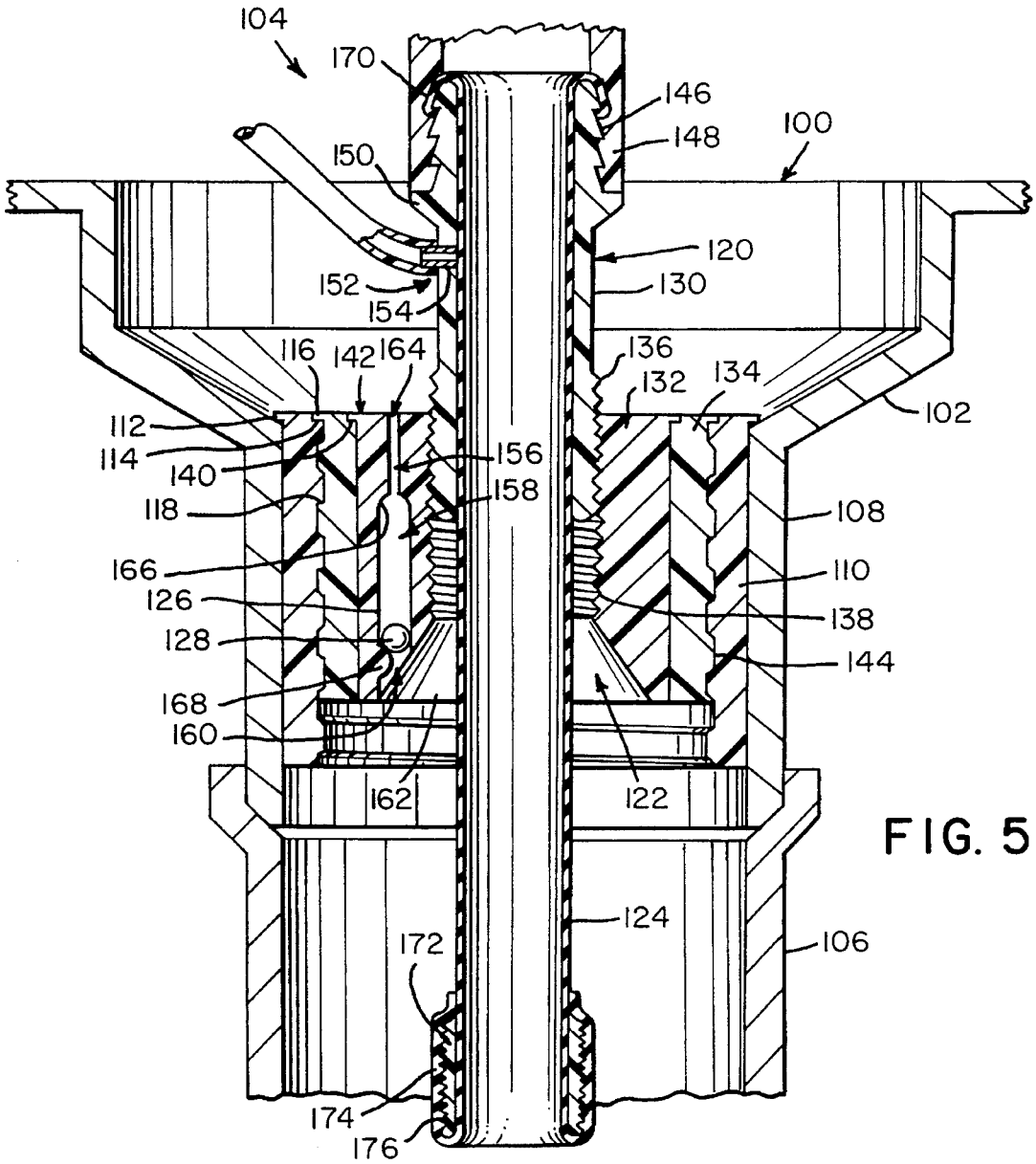
FIG. 5 is an alternative embodiment of the drain control valve shown threadably fastened within a portion of a side wall outlet box.

Referring now to FIG. 5, another embodiment of the drain control valve is depicted for use in conjunction with a side wall outlet box 100. As such a box has been fully described in my U.S. Pat. No. 4,069,837, hereby incorporated by reference for all purposes, a detailed description will not be provided herein. Nevertheless, FIG. 5 shows that the bottom of the side wall outlet box 100 is provided with a downwardly extending cup member 102 into which the drain control valve 104 may positioned. The cup member 102 allows water dripping from faucets (not shown) positioned within the box 100 to be collected therein and disposed into the stand-pipe 106 through the valve 104. The cup member 102 is provided with a tubular extension 108, adapted for connection with the top of the stand-pipe 106 and for supporting the valve 104.

Fixed within the tubular extension 108 of the cup member 102, and in fluid-tight engagement therewith, is an adaptor socket 110 for threadably receiving the drain control valve 104. The adaptor socket 110 includes an outwardly-extending peripheral flange 112 about its top for limiting the downward movement of the adaptor socket into the tubular extension 108 upon association of the two elements. Preferably, the adaptor socket 110 also includes a peripheral groove 114 about its top for the flush receipt and similar support of an outwardly-extending peripheral flange 116 from the valve 104. Also, provided about the interior surface of the adaptor socket 110 are threads 118 for engagement with the drain control valve 104.

The drain control valve 104 includes a body indicated generally at 120 having a central, axially-extending passageway 122 within which is disposed an elastomeric valve member 124 adapted for preventing the back-flow of fluids through the passageway 122. A secondary passageway or aperture 126, in the body 120, having a ball valve element 128 disposed therein interconnects the passageway 122 with the atmosphere and acts as an anti-siphon feature. Thus, it is to be understood that the drain control valve 104 checks the unintended flow of fluid through the passageway in both directions.

The preferred valve body 120 is of three-part construction and comprises: inlet member 130, outlet member 132, and threaded adaptor sleeve 134. As may be seen, the inlet member 130 is a hollow tube having, at its lower end, threads 136 about the exterior thereof. Likewise, the outlet member 132 is a hollow tube, albeit with a larger relative diameter than that of the inlet member 130, having threads 138 about its interior which are adapted for fluid-tight engagement with threads 136. When threadably engaged, the tubular inlet and outlet members 130 and 132 define the passageway 122 which is the principal fluid conveyance channel through the valve 104. Secured in fluid-tight engagement to the periphery of the outlet member 132 is the threaded adaptor sleeve 134 for threaded engagement with the adaptor socket 110 fixed within the cup member 102.

Like the adaptor socket 110, the threaded adaptor sleeve 134 includes both a peripheral flange 116 and a laterally-disposed peripheral groove 140 about its top. The peripheral flange 116 is adapted for flush engagement with the peripheral groove 114 of the adaptor socket 110. The peripheral groove 140, on the other hand, is provided to closely receive a peripheral flange 142 extending outwardly from the top of the outlet member 132. Threads 144 about the exterior periphery of the adaptor sleeve 134 permit threaded engagement with the threads 118 of the adaptor socket 110 for fluid-tight attachment of the valve 104 to the cup member 102.

The inlet member 130 includes a plurality of laterally-spaced, peripheral ridges 146 at its upper end for securely gripping a resilient drain hose 148. A peripheral flange 150 is disposed adjacent the lowermost one of the ridges 146 and extends outwardly beyond such so as to provide a stop capable of exactly positioning the drain hose 148 upon the inlet member 130. Positioned between the peripheral flange 150 and the threads 136 is a bore 152 which traverses a side wall of the inlet member 130, intersecting the passageway 122 and providing fluid communication therebetween. A tubular tap 154 is secured within bore 152 so that the external end portion of the tap 152 is in fluid communication with the passageway 122.

An aperture 126, positioned within a side wall of the outlet member 132, interconnects the passageway 122 with the atmosphere. The aperture 126 is provided with an upper section 156 and an lower section 158, in fluid communication therewith, having a relatively smaller diameter. As shown, the aperture 126 is positioned substantially parallel to the passageway 122, and has a single entrance at each of its opposed ends. A lower entrance 160, in an upwardly sloping and conically-shaped wall 162 extending from the threads 138 to the bottom of the outlet member 132, provides direct access to the lower section 158. An upper entrance 164, on the other hand, in the top of the outlet member 132, provides direct access to the upper section 156.

A longitudinally movable ball valve element 128, having a diameter somewhat greater than that provided to the upper section 156, is positioned within the lower section 158. Thus, a valve seat 166 is formed at the junction of the upper and lower sections 156 and 158. An integral projection 168 partially traverses the lower entrance 160 to maintain ball valve element 128 within the lower section 158. Thus, the movement of the ball valve element 128 within the lower section 158 is limited by the projection 168 when the aperture 126 is open for fluid flow and by the valve seat 166 when the aperture 126 is in a closed position due to pressure build-up within the passageway 122.

With continuing reference to FIG. 5, it may be seen that portions of the cup member 102 of the side wall outlet box 100 project above the outlet member 132 to a predetermined height and that the aperture entrance 164 is at an elevation lower than that of the top of the cup member 102. Thus, small amounts of liquid which inadvertently leak around the valve seat 166 under conditions of excessive fluid pressure in the passageway 122 will be collected within the open space formed within the cup member 102 and will not spill onto a floor or other surface. When the conditions of excessive pressure within the passageway 122 are relieved, the collected liquid will drain under the force of gravity through the aperture 126 and into the passageway 122 for ultimate disposal.

Fixed substantially within the central, axially-extending passageway 122 of the valve body 120 is an elastomeric valve member 124. The elastomeric valve member 124 may be formed of any suitable elastomeric material such as natural or synthetic rubber or any appropriate type of plastic. The elastomeric valve member 124 is molded or otherwise manufactured to have a tubular form of substantially constant diameter and wall thickness throughout its length. Preferably, the outer diameter of the elastomeric valve member 124 is not larger than the inner diameter of the inlet member 130 so that the collapse of the elastomeric valve member, under conditions of back-pressure in the passageway 122, will not be encumbered. As illustrated, the upper end of the elastomeric valve member 124 is fixed to the upper end of the inlet member 130 by having a portion thereof turned back as indicated at 170 over the upper end of the inlet member 130 so that such turned back portion will engage at least one of the plurality of peripheral ridges 146.

Thus, the inner wall of the drain hose 148 will press against the turned back portion 170 of the elastomeric valve member 124 and compress it into at least one of the peripheral ridges 146, thereby forming a water-tight seal between the upper end of the elastomeric valve member 124 and the valve body 120.

A ring 172 is secured to the lower, free end of the elastomeric valve member 124 for retaining such in an open configuration and under slight tension. The ring 172 is secured in place by turning back a portion of the elastomeric valve member, as indicated at 174, over the ring 172 so that such turned back portion 174 will engage the peripheral surface of the ring 172 and fully isolate such from potential contact with fluids passing through the valve 104. As shown, the ring 172 comprises a pipe nipple, formed from a corrosion-resistant material such as brass, having threads 176 about its external periphery. Preferably, the ring 172 has an outer diameter greater than that of the inner diameter of the inlet member 130 so as to prevent the complete passage of the ring 172 and the elastomeric valve member 124 through the passageway 122 under extreme back-pressure conditions. Further, the preferred ring 172 has an inner diameter sufficient to receive the elastomeric valve member 124 without substantially restricting the cross-sectional area available for fluid flow through the elastomeric valve member.

Preferably, the valve body of each embodiment of the invention is made of polyvinyl chloride (PVC) or similar plastic material but may be made wholly of metal or ceramic to suit user needs. PVC, because of its great durability and resistance to detergent solutions, is ideal for applications wherein the invention is used with clothes washing machines. Of course, to firmly secure the various elements comprising each of the valve bodies together in watertight fashion, a suitable adhesive cement may be employed at the joints therebetween.

While the above-described valve embodiments are especially adapted for use with machines such as clothes washers, dish washers and the like, it is believed that such are also well suited for use in other environments. For instance, such valves may be of particular utility in an oilfield or industrial settings as a check valve capable of alerting users of excessive back-pressure in flowlines carrying liquid chemical compositions. Additionally, with the provision of a suitable electrical control circuit, the instant valves may be of use in the computer-controlled "smart" homes now being developed wherein a back-pressure situation in a drain line may be responded to by a preprogrammed digital device. Further, as described hereinbelow, the inventive valves may be used in the distribution of water through an irrigation system.

Figure 6:
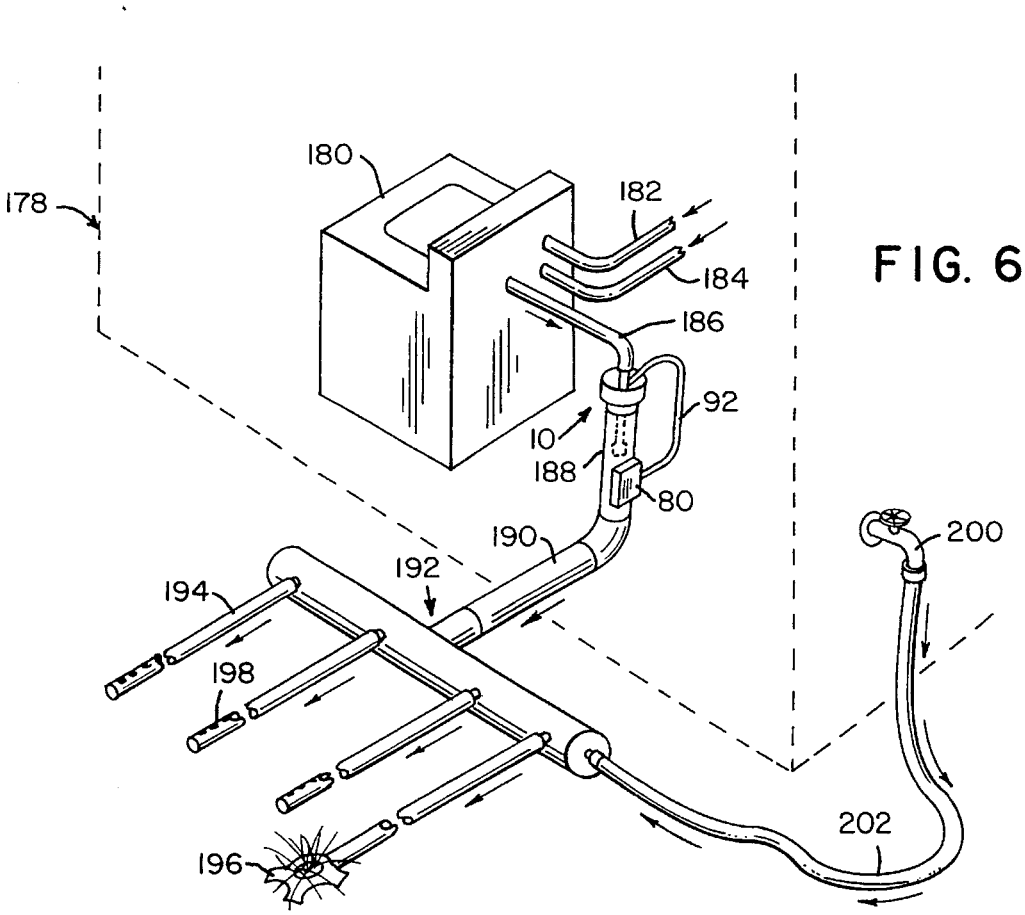
FIG. 6 is a schematic view of a building structure piped to utilize the drain control valve and manifold system of the present invention for irrigation purposes.

Referring to FIG. 6, a building structure 178 containing a clothes washing machine 180 is piped to utilize the waste or "grey" water generated by the clothes washing machine for lawn and garden irrigation purposes. By utilizing such a system, the grey water may be advantageously employed and need not be flushed into a municipal sewage system for costly treatment and disposal. As shown, the washing machine 180 is provided with inlets 182 and 184 from which it receives hot and cold water, respectively, for washing purposes. After use within the washing machine 180, the grey water discharged therefrom, which contains relatively small amounts of soap or detergent residues, is conveyed through the drain hose 186 into the drain control valve 10 (shown by way of example only as any of the valve embodiments of the instant invention may be employed herein) secured atop the stand-pipe 188. A conduit 190, in fluid communication with the stand-pipe 188, passes through the building wall to the outdoors and there is connected to a manifold 192 which, in turn, supplies grey water to a plurality of feeder hoses 194. Although a plurality of feeder hoses 194 are shown, it should be apparent that their number may be varied from a great multiplicity down to a single hose 194 according to grey water supply volumes, surrounding terrain, and user needs.

Grey water may be distributed to the ground surface from a sprinkler 196 at the remote terminus of each feeder hose 194 or along the length thereof through perforations as at 198 if the hose terminus is plugged for a more even distribution of the grey water. Of course, the perforations 198 may be either individually formed in an otherwise impermeable hose material or formed "in mass" in the manner associated with well-known soaker hoses.

Additional water volumes may be delivered to the manifold 192 from a spigot 200 in fluid communication with a municipal water source (not shown) for flushing the feeder hoses 194 and soaking the irrigated ground surface. Preferably, an ordinary garden hose 202 is used to place the spigot 200 and manifold 192 in fluid communication with one another. To prevent grey water from inadvertently entering the garden hose 202 and upstream municipal water supply, back-flow prevention means are provided within the manifold 192.

Figure 7:
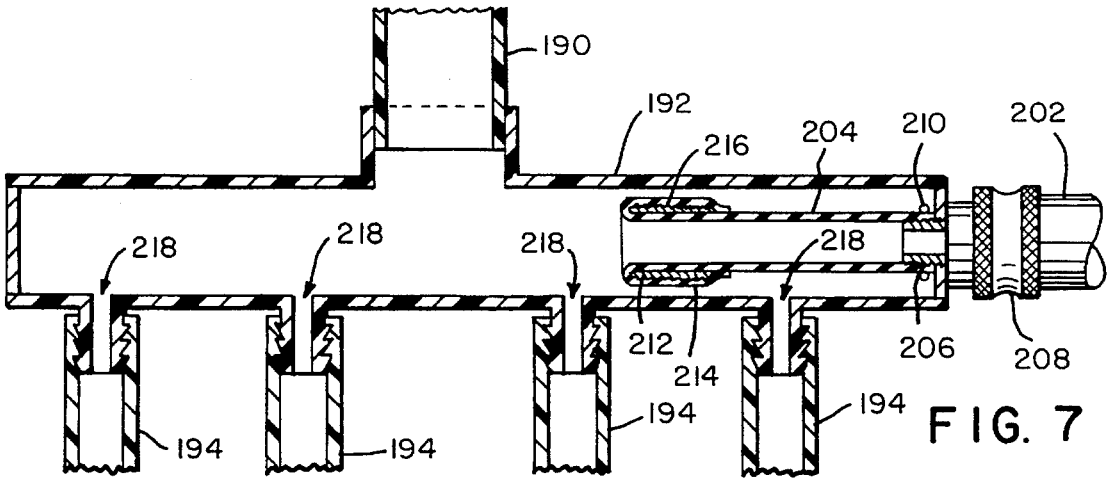
FIG. 7 is cross-sectional view of the fluid distribution manifold of FIG. 6 showing details thereof.

With reference to FIG. 7, an elastomeric valve member 204 can be seen secured within the manifold 192 for preventing the back-flow of fluids into the hose 202. The elastomeric valve member 204 may be formed of any suitable elastomeric material such as natural or synthetic rubber or any appropriate type of plastic. The elastomeric valve member 204 is preferably molded or otherwise manufactured to have a tubular form of substantially constant diameter and wall thickness throughout its length which may be any suitable fraction of the manifold length. Regardless of length, the outer diameter of the elastomeric valve member 204 is, preferably, sufficiently smaller than the inner diameter of the manifold 192 so that the flow of grey water from the manifold into the feeder hoses 194 will not be significantly impeded by the presence of the elastomeric valve member 204 within the manifold.

As illustrated, the elastomeric valve member 204 is joined to the inwardly projecting, threaded portion 206 of the female hose fitting 208 by a suitably sized locking ring 210. The free end of the elastomeric valve member 204 is provided with a ring 212 for retaining such in an open configuration and preventing movement of the free end of the elastomeric valve member 204 into the hose fitting 208 under back-flow conditions. The ring 212 is secured in place by turning back a portion of the elastomeric valve member 204, as indicated at 214, over the ring 212 so that such turned back portion 214 will engage the peripheral surface of the ring 212 and completely isolate such from contact with grey water passing through the manifold 192. As shown, the ring 212 comprises a pipe nipple, formed from a corrosion-resistant material such as brass, having threads 216 about its external periphery. Preferably, the ring 212 has an outer diameter greater than that of the inner diameter of the threaded portion 206 so as to prevent the passage of the ring 212 and the elastomeric valve member 204 through the female hose fitting 208 under back-pressure conditions. Further, the preferred ring 212 has an inner diameter sufficient to receive the elastomeric valve member 204 without substantially restricting the cross-sectional area available for water flow through the elastomeric valve member 204.

The mass of the ring 212 may be varied at installation in response to differences in the thickness and composition of the material comprising the elastomeric valve member 204 as well as conditions of use. As the manifold 192 would normally be installed with its longitudinal axis parallel to the ground surface, stretching of the elastomeric valve member 204 and the internal stresses caused thereby would ordinarily be minimal and not a problem. However, the preferred mass would, under conditions of normal fluid flow through the manifold 192, act as a sinker to retain the free end of the elastomeric valve member 204 at the bottom of the manifold and, simultaneously, space the valve member 204 from the manifold outlets 218 positioned in the sides thereof.

From the foregoing description, it will be apparent that there is provided by the present invention a drain control valve, which, when installed in a fluid carrying conduit, will function to prevent the back-flow of fluid therethrough. This operation is continuous and automatic at all times that the drain control valve is installed. Even if the drain control valve should fail because of a rupture or deterioration of the elastomeric valve member, the valve will continue to alert the user to a back-pressure situation through the activation of the pressure sensitive control unit. Of course, when fluid is passing through the drain control valve in a desired direction, the elastomeric valve member will remain open and not impede in any way the flow of fluid therethrough.

While the invention has been described with a high degree of particularity, it will be appreciated by those skilled in the art that numerous modifications and substitutions may be made to the valve bodies of the several embodiments of the invention. For example, the valve bodies may be integrally formed rather than assembled from a plurality of separate components. Therefore, it is to be understood that the present invention is not limited to the embodiments described above, but encompasses any and all embodiments within the scope of the following claims.

I claim:

1. A valve, comprising:

a valve body having a rigid wall defining inlet and outlet openings at opposite ends thereof and a main flow passageway between said inlet and outlet openings;

a tubular valve member of elastomeric material having upstream and downstream ends in fluid communication with one another, said upstream end secured to said rigid wall so as to receive fluid entering said passageway through said inlet opening, said tubular valve member being normally open to fluid flow but being yieldingly collapsible in response to downstream pressure increases to prevent fluid from passing therethrough; and, a ring secured about said tubular valve member, said ring dimensioned to prevent the passage of said downstream end through said inlet opening in the event of a downstream pressure increase.

2. The valve according to claim 1 wherein said tubular valve member is positioned within said main flow passageway.

3. The valve according to claim 1 wherein said downstream end of said tubular valve member is positioned on the exterior of said valve body.

4. The valve according to claim 1 wherein said ring has an outer diameter greater than the inner diameter of said passageway.

5. The valve according to claim 1 wherein the mass of said ring is sufficient to maintain said tubular valve member substantially fully extended when said valve is disposed in an upright orientation.

6. The valve according to claim 1 wherein said downstream end of said tubular valve member is turned back and over the outside of said ring.

7. The valve according to claim 1 wherein said rigid wall of said valve body includes an aperture between said inlet and outlet openings for connecting said main flow passageway with the atmosphere, said aperture having a lower section and an upper section in fluid communication with one another, said upper section having a cross sectional area available for fluid movement which is relatively less than that of the lower section so as to form a valve seat at the junction between said lower and upper sections; and, said drain control valve further comprising: a ball valve element positioned within said lower section and adapted for close engagement with said valve seat; and, a projection partially traversing the bottom of said lower section for maintaining said ball valve element therein.

8. The valve according to claim 1 wherein the periphery of said valve body is threaded.

9. The valve according to claim 1 further comprising:

means for sensing pressure operably connected to said valve body and in fluid communication with said main flow passageway; and an electrical control circuit including a normally open switch connected to said pressure sensing means and adapted to be closed when pressure in said main flow passageway exceeds a predetermined level, and said circuit including means for signaling a user operable upon closing of said circuit.

10. The valve according to claim 7 wherein said valve body comprises:

a tubular inlet member;

a tubular outlet member secured to said tubular inlet member; and, a cup member secured to the periphery of said outlet member and having an upper cylindrical portion for collecting liquid passing through said aperture.

11. The valve according to claim 10 wherein said inlet member includes peripheral flange proximate said inlet opening for positioning a hose on said inlet member.

12. A control valve and manifold system, comprising:

a valve including:

a valve body having a rigid wall defining inlet and outlet openings at opposite ends thereof and a main flow passageway between said inlet and outlet openings;

a first tubular valve member of elastomeric material having first upstream and downstream ends in fluid communication with one another, said first upstream end secured to said rigid wall so as to receive fluid entering said passageway through said inlet opening, said first tubular valve member being normally open to fluid flow but being yieldingly collapsible to prevent fluid from passing therethrough in response to downstream pressure increases; and, a first ring secured about said first tubular valve member, said ring dimensioned to prevent the passage of said first downstream end through said inlet opening in the event of a downstream pressure increase; and, a manifold having a first fluid inlet in fluid communication with said outlet opening of said valve body and having at least one fluid outlet for the distribution of fluids therefrom.

13. The control valve and manifold system according to claim 12 wherein said manifold further includes:

a second fluid inlet adapted for connection to a fluid source; and, a second tubular valve member of elastomeric material having second upstream and downstream ends in fluid communication with one another, said second upstream end secured to said second fluid inlet so as to receive fluid entering said manifold through said second fluid inlet, said second tubular valve member being normally open to fluid flow but being yieldingly collapsible to prevent fluid from passing therethrough in response to downstream pressure increases.

14. The control valve and manifold system according to claim 13 wherein said manifold further includes a second ring secured about said second tubular valve member, said second ring being dimensioned to prevent the passage of said second downstream end through said second fluid inlet in the event of a downstream pressure increase.

15. The control valve and manifold system according to claim 14 wherein said second ring has an outer diameter greater than the inner diameter of said second fluid inlet.

16. A valve, comprising:

a valve body having a rigid wall defining inlet and outlet openings at opposite ends thereof and a main flow passageway between said inlet and outlet openings;

a tubular valve member of elastomeric material having upstream and downstream ends in fluid communication with one another, said tubular valve member positioned within said main flow passageway such that said upstream end receives fluid entering said passageway, said tubular valve member being normally open to fluid flow but being yieldingly collapsible to prevent fluid from passing therethrough in response to downstream pressure increases; and, a ring secured about said tubular valve member, said ring dimensioned to prevent the passage of said downstream end through said inlet opening in the event of a downstream pressure increase.

17. The valve according to claim 16 wherein said rigid wall of said valve body includes an aperture between said inlet and outlet openings for connecting said main flow passageway with the atmosphere, said aperture having a lower section and an upper section in fluid communication with one another, said upper section having a cross sectional area available for fluid movement which is relatively less than that of the lower section so as to form a valve seat at the junction between said lower and upper sections; and, said drain control valve further comprising: a ball valve element positioned within said lower section and adapted for close engagement with said valve seat; and, a projection partially traversing the bottom of said lower section for maintaining said ball valve element therein.

18. The valve according to claim 16 wherein said ring has an outer diameter greater than the inner diameter of said passageway.

19. The valve according to claim 18 further comprising:

means for sensing pressure operably connected to said valve body and in fluid communication with said main flow passageway; and an electrical control circuit including a normally open switch connected to said pressure sensing means and adapted to be closed when pressure in said main flow passageway exceeds a predetermined level, and said circuit including means for signaling a user operable upon closing of said circuit.

20. The valve according to claim 17 wherein said valve body comprises:

a tubular inlet member;

a tubular outlet member secured to said tubular inlet member; and, a cup member secured to the periphery of said outlet member and having an upper cylindrical portion for collecting liquid passing through said aperture.

* * * * *